US005613673A

United States Patent [19]

Roberts et al.

[11] Patent Number: 5,613,673

[45] Date of Patent: Mar. 25, 1997

[54] SHEET STACKING APPARATUS

[75] Inventors: Shayne A. Roberts; Carl R. Marschke, both of Phillips, Wis.

[73] Assignee: Marquip, Inc., Phillips, Wis.

[21] Appl. No.: 515,305

[22] Filed: Aug. 15, 1995

[51] Int. Cl.[6] ..... B65H 29/68

[52] U.S. Cl. ..... 271/182; 271/183; 271/215; 271/218; 271/220; 271/221; 414/790.8; 414/791.2

[58] Field of Search ..... 271/182, 183, 271/214, 215, 217, 218, 221, 220; 414/790.8, 791.2, 794.8, 796.6

[56] References Cited

U.S. PATENT DOCUMENTS

| | | | |
|---|---|---|---|
| 1,366,938 | 2/1921 | Renz . | |
| 2,645,476 | 7/1953 | Wood et al. . | |
| 2,839,295 | 6/1958 | Bernard, Jr. . | |
| 3,892,168 | 7/1975 | Grobman . | |
| 4,084,809 | 4/1978 | Looney | 271/220 |
| 4,134,330 | 1/1979 | Weickenmeier . | |
| 4,765,790 | 8/1988 | Besemann | 414/790.8 X |
| 4,949,953 | 8/1990 | Claassen et al. | 271/218 |
| 4,966,521 | 10/1990 | Frye et al. . | |
| 5,102,117 | 4/1992 | Henn et al. | 271/218 X |
| 5,145,159 | 9/1992 | Vits | 414/790.8 X |
| 5,374,051 | 12/1994 | Ulrich et al. | 271/221 X |

*Primary Examiner*—David H. Bollinger
*Attorney, Agent, or Firm*—Andrus, Sceales, Starke & Sawall

[57] ABSTRACT

A downstacker for paperboard sheets includes a sheet speed reducing shingler positioned in the stacking station and forming a shingling nip with the top sheet of the continuously descending stack. The shingling nip is positioned to engage and nip the next following sheet simultaneously with engagement of the stacking station backstop by the preceding sheet, thereby obviating sheet marking by an overrunning nip roll. A false backstop is periodically interposed to define a stack separation level and create an offset in the stack which engages the end of a separating fork as the continuously forming stack descends to facilitate insertion of the fork supporting into the stack. The fork provides interim support for the upper stack portion which continues to form while the lower stack portion is rapidly discharged.

14 Claims, 7 Drawing Sheets

SHEET STACKING APPARATUS

BACKGROUND OF THE INVENTION

The present invention pertains to a system for stacking serially delivered sheets and, more particularly, to an apparatus and method for high speed formation and discharge for stack portions of a precounted number of sheets from a continuously forming stack.

Stacking apparatus for paper and paperboard sheets are well known in the art. The manufacture of paper or paperboard products from individual sheets of material typically requires a stacking of the paper or paperboard sheets in at least one step of the manufacturing process. Indeed, many converting processes require that paper or paperboard sheets be stacked more than one time in the overall process. In the manufacture of corrugated paperboard containers, paperboard sheets are typically stacked after leaving the corrugator dry end for eventual feed into the box blank forming apparatus (a flexo-folder-gluer) and the folded knocked down boxes are again restacked after formation in the flexo. In both cases, the number of sheets or sheet-like items in the stack must be accurately counted and separated.

It is common to compress a continuous stream of sheets being delivered for stacking by shingling the stream of sheets upstream of the stacker and feeding the preshingled stream directly into a continuously descending downstacker with the sheets being stopped by engagement with a backstop wall. Typically, the sheets must be slowed for stacking to maintain control and prevent lead edge sheet damage. U.S. Pat. No. 4,966,521 discloses a stacking system in which a continuous stream of sheets which are spaced end-to-end is delivered to a downstacker with sheet slow down and control effected by controlled sequential nipping of the tail ends of the sheets to slow each sheet just before the lead edge contacts the backstop. This patent also discloses a lower stack separating wedge which is driven horizontally into the stack to create a bottom stack portion for separate discharge from the system.

It is also known to utilize vertically reciprocable stop gates or false backstops to provide a staggered offset in a vertically forming stack in response to counting mechanisms to divide the stack into preselected stack portions of a given number of sheets. Examples of such apparatus are shown in U.S. Pat. Nos. 1,366,938; 2,645,476 and 2,839,295.

Folded knocked down boxes from a flexo-folder-gluer are counted and stacked for discharge in one type of device known as a counter ejector. One conventional type of counter ejector is shown in U.S. Pat. No. 3,580,145 in which stacks of folded boxes are individually formed and serially ejected from the apparatus.

U.S. Pat. No. 3,892,168 shows a counter ejector in which a stack of folded boxes is continuously formed on a vertically descending platform in the stacking station. When a precounted number of boxes has been stacked, support fingers move over the top of the stack to intercept the continuous stream of boxes that follows to provide temporary support while the lower precounted stack portion is discharged, after which the platform moves vertically upwardly to the position of the support fingers which are withdrawn from the next stack portion forming thereon.

U.S. Pat. No. 4,134,330 describes a device for feeding folded box blanks serially and individually into a downstacker. When the desired number of blanks in a stack portion has been reached, the first blank of the next following stack portion is deflected laterally from the feed path into the stacker where it is supported on a secondary support mechanism and where the following blanks of the second stack portion are also deposited while the preceding stack portion is being discharged.

SUMMARY OF THE INVENTION

The present invention provides an apparatus and related method for the continuous high speed stacking and discharge of paperboard sheets which may comprise individual sheets or folded knocked down boxes. The sheets are fed in a continuous stream onto a descending downstacker platform where the sheets are slowed prior to contact with the backstop by a shingling nip which is positioned above the stack and located at a distant from the backstop to cause the leading edge of the next following sheet to be nipped simultaneously with engagement by the leading edge of the preceding sheet with the backstop. This system also includes means for forming an upstream offset in the stack of sheets being formed to provide an entry and separating position for a supporting fork operative to support the continuously forming stack while the lowermost stack portion is separated and discharged.

More particularly, the apparatus includes means for conveying a stream of sheets at an initial speed into a stacking station which includes a vertically movable stack support surface. A vertical rear wall in the stacking station provides a backstop for the incoming sheets. Shingling means in the stacking station slows the lead sheet in the stream to a second speed and carries the leading edge of the lead sheet into engagement with the backstop. The shingling means comprises a backstop nip roll which is positioned above the stack support surface to define a nip which is spaced from the backstop by a distance approximately equal to the distance between the leading edge of the next following sheet and the backstop. In this manner, the leading edge of the next following sheet is nipped just as the leading edge of the lead sheet engages the backstop.

The apparatus also includes means for moving the stack support surface downwardly in response to stack formation. Specifically, the stack support surface is moved downwardly at a rate equal to the rate of stack formation.

The shingling means may also include a vacuum shingler which is positioned between the sheet delivery means and the stack support surface. The sheet delivery means preferably comprises a belt conveyor having its downstream end positioned adjacent the vacuum shingler, and including an infeed nip roll positioned above the downstream end of the conveyor to form an infeed control nip for the sheets.

The backstop nip roll is mounted on a pivotable support for rotation about a horizontal axis to vary the vertical position of the nip roll. Control means are provided which are responsive to movement of the pivotal support of the nip roll for controlling the downward speed of the stack support surface.

The apparatus also includes a false backstop which is positioned to move vertically along the wall of the backstop between an upper inoperative position and a lower operative position in the path of sheets passing through the backstop nip. The false backstop provides an upstream offset in the stack of sheets being formed which is defined by the trailing edges of a selected number of sheets. A stack separating and supporting fork is mounted below the sheet conveying means and controlled for horizontal supporting movement into the stack and vertical movement responsive to movement of the stack support surface. This supporting fork includes free end portions which are positionable adjacent the upstream face of the stack so that they engage the upstream offset in response to vertical downward stack movement. Control means are provided for varying the rate of movement of the stack support surface in response to horizontal movement of the supporting fork into the stack to provide separation of the lower stack portion on the stack support surface for discharge. The stack support surface includes a discharge conveyor which is operative to provide horizontal discharge of the lower stack portion.

The related method of the present invention includes the steps of conveying the sheets at a first speed into a stacking station which includes a vertical sheet engaging backstop; successively slowing the lead sheet in the stream entering the stacking station to a second speed prior to engagement with the backstop; lowering the stack at a vertical rate approximately equal to the rate of stack formation; creating an upstream offset in the stack of sheets being formed, which offset is defined by the trailing edges of a selected number of sheets; positioning the end of a stack separating device in the path of the offset to engage the offset during the stack lower step; moving the separating device horizontally into the stack and under the offset to separate the stack into lower and upper stack portions; and, discharging the lower stack portion from the vertical path of stack formation.

More specifically, the step of successively slowing the lead sheet entering the stacking station comprises nipping the lead sheet between a nip roll and the next preceding sheet on the stack. The offset creating step preferably comprises moving a false backstop into the path of the selected number of sheets entering the stacking station. The method further includes the step of increasing the rate of lowering the lower stack portion in response to movement of the separating device into the stack.

DETAILED DESCRIPTION OF THE PREFERRED EMBODIMENT

Figure 1:
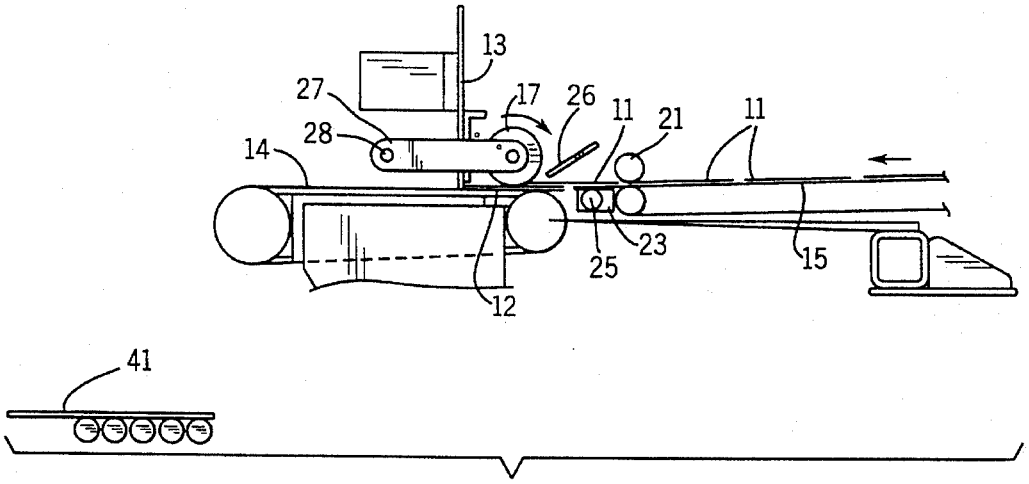
FIG. 1 is a schematic side elevation of the apparatus of the present invention in its initial startup position.

FIG. 1 shows the sheet stacking and discharge apparatus of the present invention in its initial startup position with the lead sheet 10 of a stream of incoming sheets 11 positioned in a stacking station 12 with its lead edge in engagement with a vertical backstop 13. The stacking station 12 includes a vertically movable stack support surface 14 which, in the preferred embodiment, comprises the conveying surface of an belt conveyor 14. The incoming stream of sheets 11 is delivered to the stacking station 12 on an infeed belt conveyor 15 carrying the sheets at a first speed in closely spaced relation.

The sheets 11 may comprise unitary flat sheets of solid fiber or corrugated paperboard. The sheets may also comprised folded and glued paperboard cartons comprising two face-to-face layers flattened and joined by glued overlapping edge portions. In either case, stacks of a desired number of sheets are formed and discharged from the system for immediate downstream processing or for banding and shipment.

The infeed conveyor 15 delivers the sheets at high speed and it is important to slow the sheets prior to engagement with the backstop 13 to prevent sheet edge damage or sheet buckling. In accordance with the present invention, a shingling nip 16 is positioned in the stacking station 12 just upstream of the backstop 13. The shingling nip is created by a backstop nip roll 17 resting on the outfeed conveyor 14 (for receipt of the initial sheet) or the top sheet of the stack 18 being formed in the stacking station. The incoming lead sheet 10, traveling at the initial speed of the infeed conveyor 15, is captured in the shingling nip 16 immediately after the tail edge leaves the conveyor. Preferably, an infeed nip roll 21 is positioned above the downstream end of the infeed conveyor 15 to provide a supplemental normal control force on the sheet until the sheet is captured by the shingling device. The backstop nip roll 17 is driven at a substantially lower speed than the infeed conveyor 15 and slows the lead sheet 10 to carry the leading edge 22 into contact with the backstop 13 at a speed which precludes sheet damage. As soon as the leading edge of the lead sheet is captured in the shingling nip and slowed to the speed of the nip, the next following sheet 11, still traveling at the higher infeed conveyor speed, will overlap the lead sheet and form a shingle therewith.

The backstop nip roll 17 is positioned with respect to the backstop 13 and the respective speeds of the backstop nip roll and infeed conveyor are controlled so that the leading edge 22 of the next following sheet is nipped in the shingling nip 16 just as the leading edge of the lead sheet reaches the backstop 13. In this manner, there is no opportunity for the driven backstop nip roll 17 to turn on the top surface of a stationary sheet in contact with the backstop. Therefore, possible marring or other damage to the sheet by the nip roll is obviated.

To assist in sheet control and shingling, a vacuum shingler 23 is positioned just downstream from the end of the infeed conveyor 15 and upstream of the stacking station 12 as defined by the outfeed conveyor 14 in its uppermost position (shown in FIG. 1). The vacuum shingler includes a vacuum chamber 24 which has a slotted open upper surface through which the upper peripheral surface of a driven vacuum shingling roll 25 protrudes. The vacuum shingling roll is mounted for rotation inside the vacuum chamber 23 and is driven at the same peripheral speed as the backstop nip roll 17. As the trailing edge 20 of a sheet leaves the nip created by the infeed nip roll 21 and infeed conveyor 15, it drops onto the vacuum shingler 23 to assist in slowing the sheet and permitting the leading edge of the next following sheet to overlap and create the shingling effect. The entrance to the shingling nip 16 may be defined by a deflector plate 26 which helps to funnel the leading edge of the sheet into the nip.

Figure 2A:
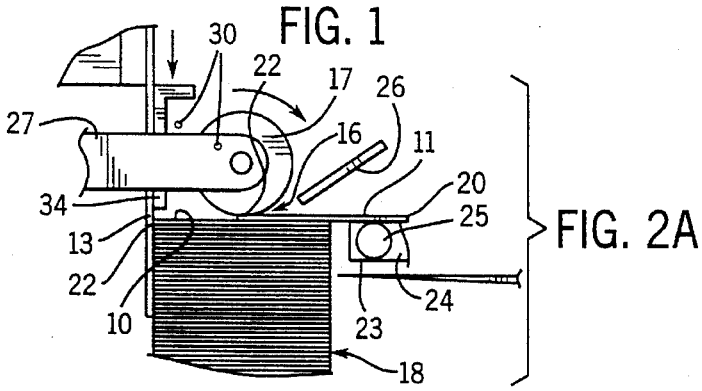
FIG. 2A is an enlarged detail of a portion of FIG. 2.
Figure 2:
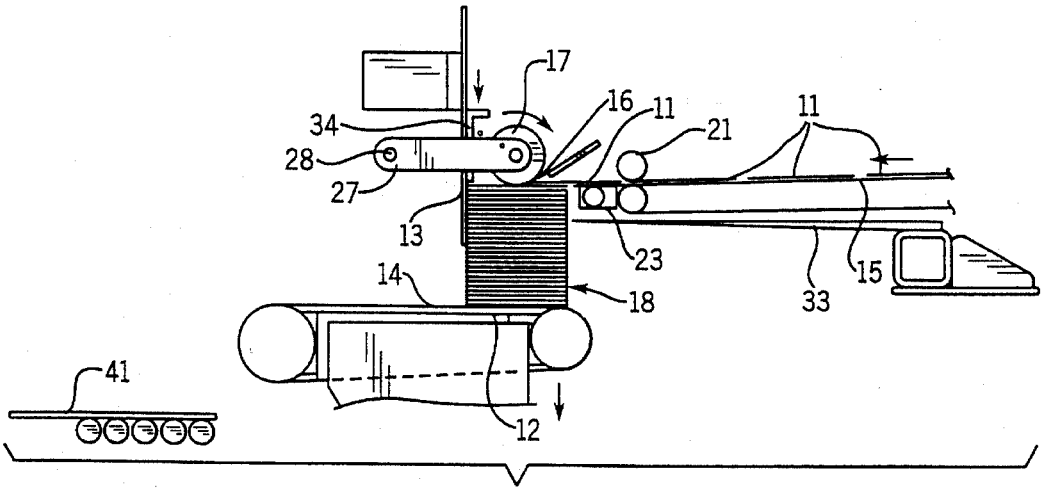
FIG. 2 is a view similar to FIG. 1 showing initial stack formation.

The outfeed conveyor 14 is mounted for reciprocal vertical movement and its downward movement is controlled so that the stack 18 of sheets being continuously formed thereon is lowered at the rate of stack formation. In this manner, the shingling nip 16 remains in a substantially constant vertical position. However, some accommodation must be made for slight variations between the incoming sheet rate (stack height formation rate) and the rate at which the stack support surface provided by the outfeed conveyor moves downwardly. Referring also to FIG. 2A, the backstop nip roll 17 is mounted on one end of a pivot arm 27 and the other end of the pivot arm is mounted to rotate about a horizontal pivot axis 28. The backstop nip roll bears on the surfaces of each of the incoming sheets 11 to provide a normal nipping force, but may float up or down within limits, via pivotal movement of the arm 27, to accommodate stack formation and outfeed conveyor descent rate variations. A pair of photoeyes 30, or other suitable limit detection mechanisms, are utilized to generate signals representing the maximum limits of upward and downward pivot arm movement and, by use of a suitable feedback control routine, the photoeye signals are utilized to control the speed of downward movement of the outfeed conveyor and thereby maintain the top of the continuously forming stack within the desired limits.

Figure 3A:
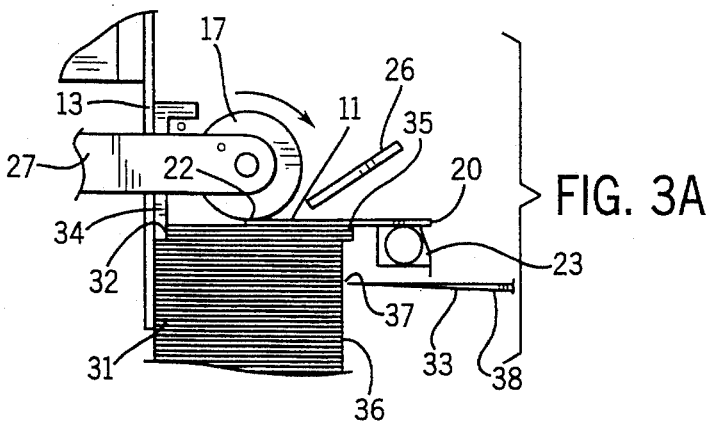
FIG. 3A is an enlarged detail of a portion of FIG. 3.
Figure 3:
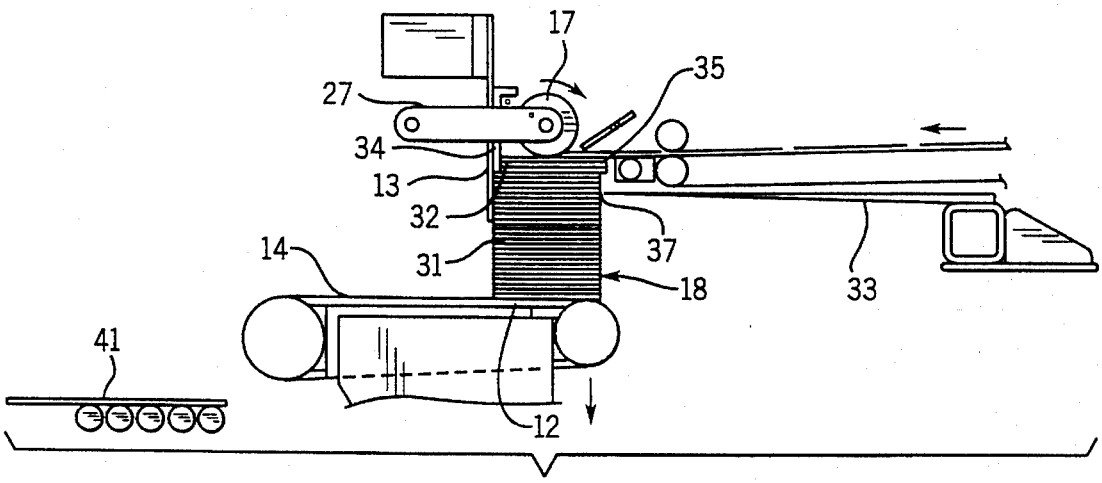
FIG. 3 is a view similar to FIG. 2 showing formation of a stack separation offset.
Figure 4A:
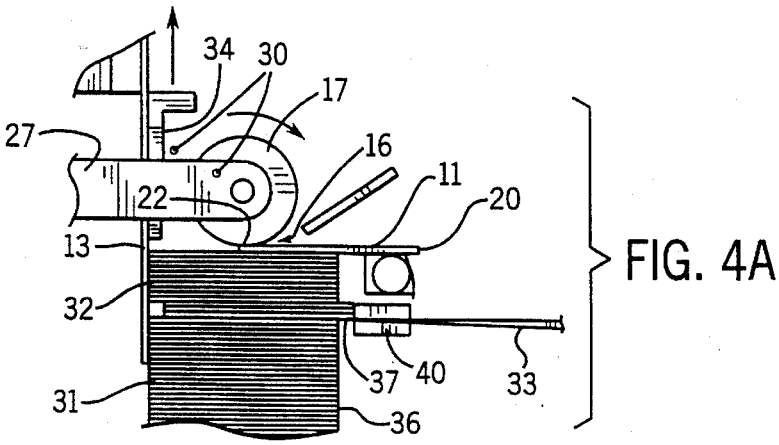
FIG. 4A is an enlarged detail of a portion of FIG. 4.
Figure 4:
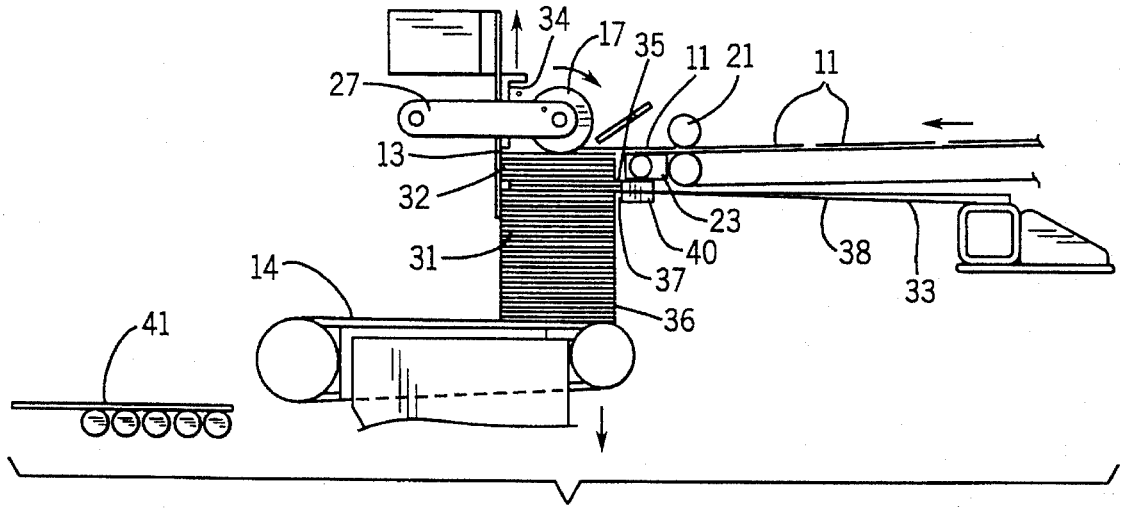
FIG. 4 is a schematic side elevation, similar to FIGS. 1–3, showing the interrelation between the offset in the stack of sheets being formed and the stack separating fork.
Figure 5:
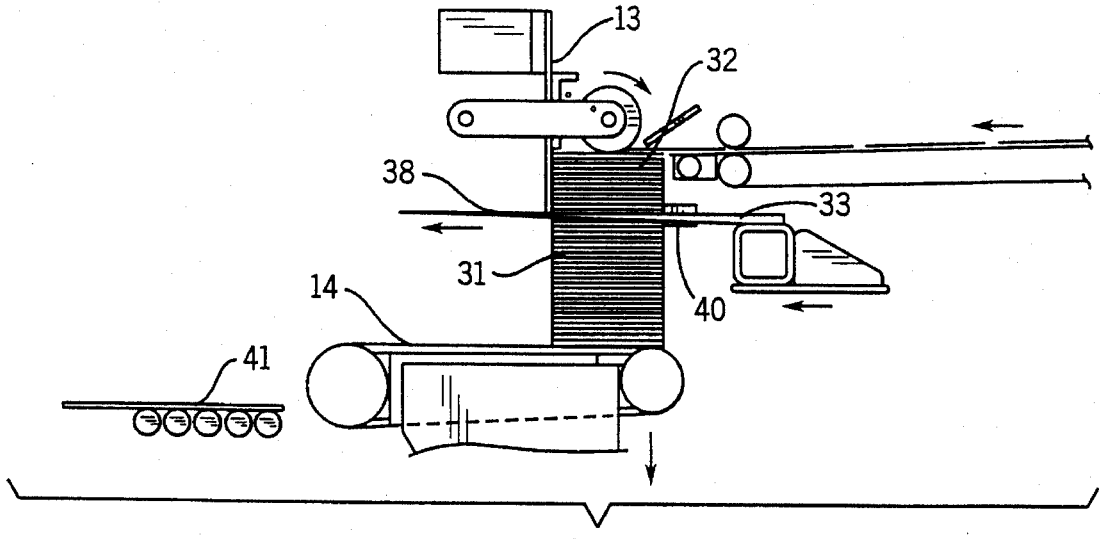
FIGS. 5–7 are schematic side elevations showing the separation and discharge of the lower stack portion from the continuously forming stack.

Referring also to FIGS. 3–5, the apparatus of the present invention also includes means for separating the continuously forming stack of sheets into a lower stack portion 31 comprising a selected number of sheets to be discharged as a unit and a partially completed upper stack portion 32 which continuously builds to completion while the lower stack portion 31 is being discharged from the system. To facilitate stack separation and intermediate support, a stack separating and supporting fork 33 is mounted below the infeed conveyor 15 for horizontal supporting movement into the continuously forming stack 18 and vertical reciprocal movement at varying speeds in response to vertical movement of the outfeed conveyor 14 and stack portions thereon. The control system for the apparatus of the present invention includes means to count the incoming sheets 11 as they are stacked on the stack support surface of the outfeed conveyor 14. When the number of sheets in a lower stack portion 31 of a desired size has been reached, a vertically reciprocable false backstop 34, mounted for sliding movement along the face of the backstop 13, is fired to move downwardly into the path of the incoming sheets (see FIGS. 3 and 3A). The next few incoming sheets engage the false backstop 34 and create an upstream offset 35 in the stack of the sheets being formed. The offset is defined by the trailing edges of the next few incoming sheets which protrude from the upstream face 36 of the stack. The free upstream ends 37 of the tines 38 of the supporting fork 33 are located closely adjacent the upstream stack face 36. However, the fork ends 37 lie directly in the path of the downwardly moving offset 35 and, as the continuously forming stack descends, the offset eventually engages the ends of the fork tines 38, resulting in a slight upward opening in the stack to allow the fork to be inserted therein by horizontal movement. The false backstop 34 is retained in its active lower position for only a time sufficient to be engaged by a few sheets, after which it is retracted upwardly and out of the path of the next incoming sheets (see FIG. 4A). Once the stack separating and supporting fork 33 has been inserted into the stack to separate the same into upper and lower stack portions 32 and 31, respectively, the rates of downward movement of the conveyor 14 and the fork 33 are separately controlled to allow the lower stack portion 31 to be independently discharged and the outfeed conveyor 14 returned to its stack supporting position for the next lower stack portion. A detailed description of the method of operation is as follows.

Referring now sequentially to the drawing figures beginning with FIG. 4, after the false backstop 34 is retracted by upward movement out of the path of the incoming sheets, the stack 18 continues to form and the stepped offset 35 likewise continues to move downwardly until it engages the fork ends 37. At this point, and referring to FIG. 5, the fork extends horizontally at a rapid rate and, immediately upon entry into the space under the offset 35, the system control operates to cause the fork to begin downward movement at the stack formation rate. An offset squaring device or spanker 40, is positioned to surround the tines 38 of the fork in a manner allowing the tines to move horizontally independently of the spanker and the spanker, in turn, to move horizontally a small distance sufficient to move the sheets defining the offset 35 horizontally back into alignment with the rest of the sheets in the stack. Simultaneously with horizontal movement of the fork into the stack, the spanker 40 is fired to eliminate the offset 35.

Figure 6:
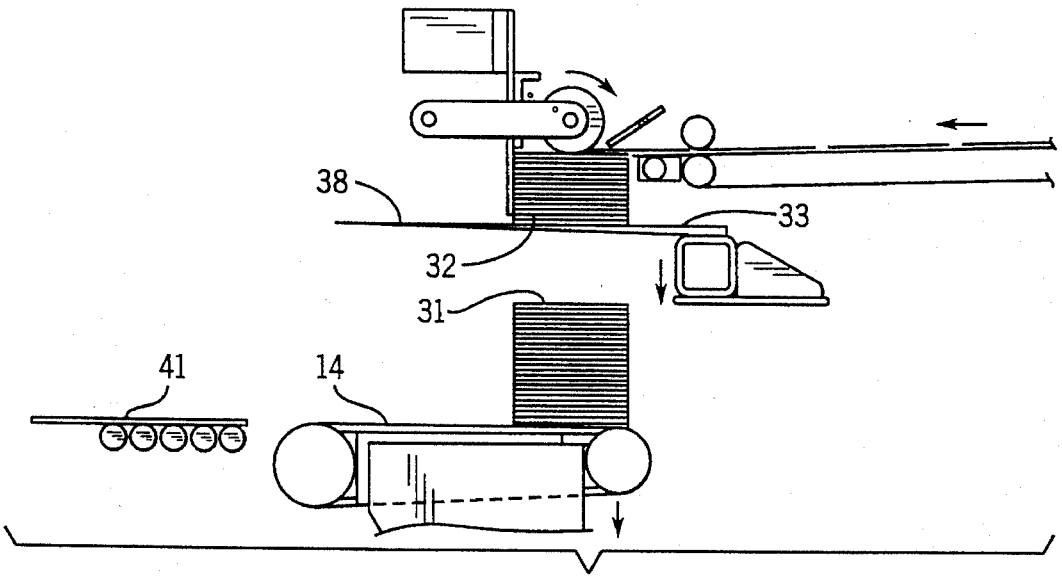
Figure 7:
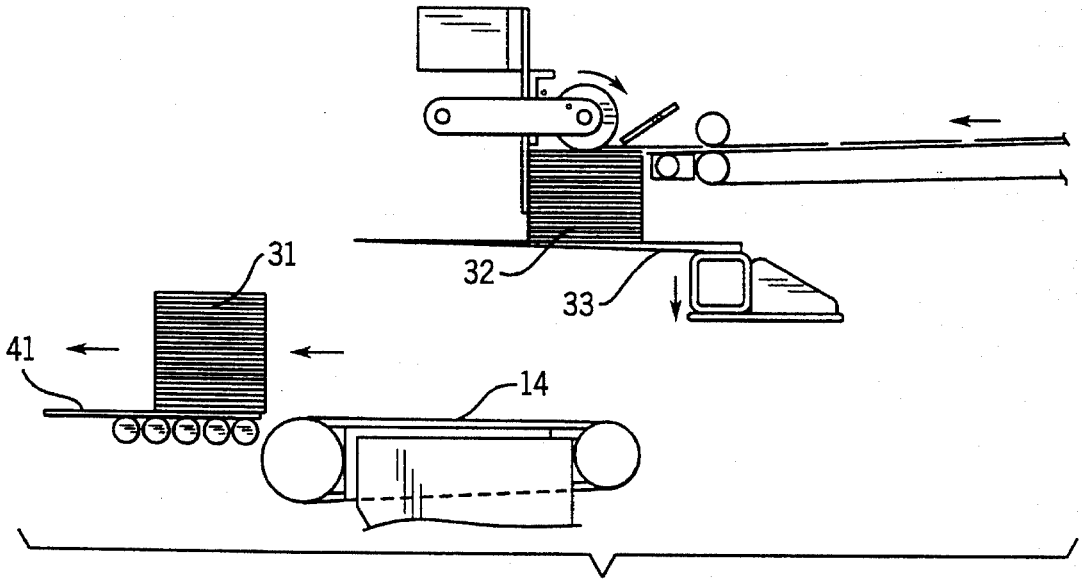
Figure 8:
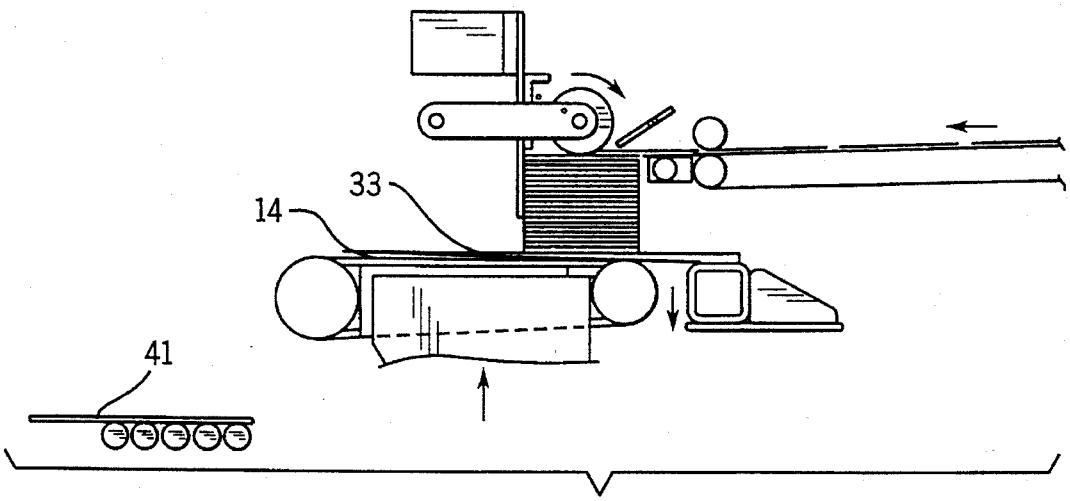
FIGS. 8–13 are schematic side elevations of continuing operation of the system to separate and discharge the next following stack portion.
Figure 9:
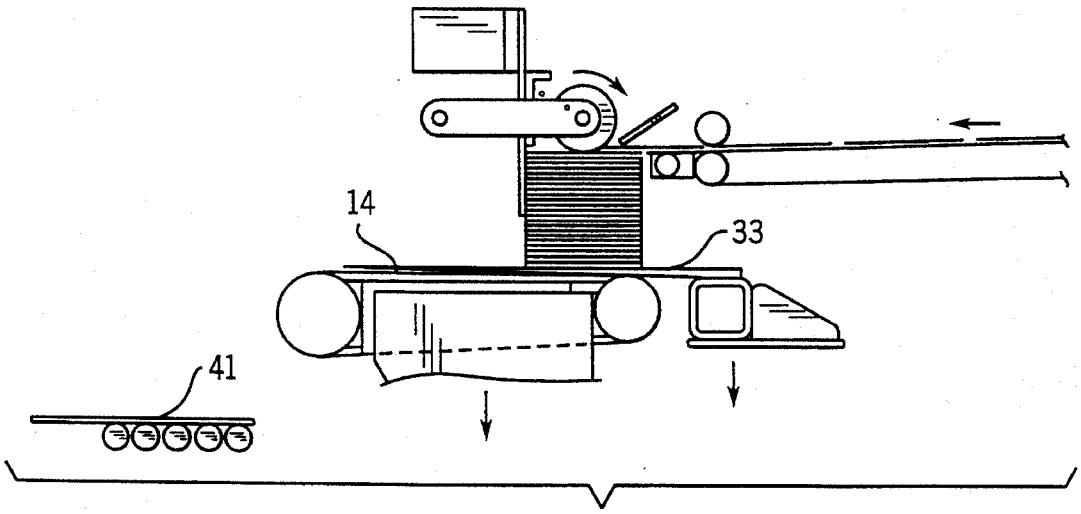
Figure 10:
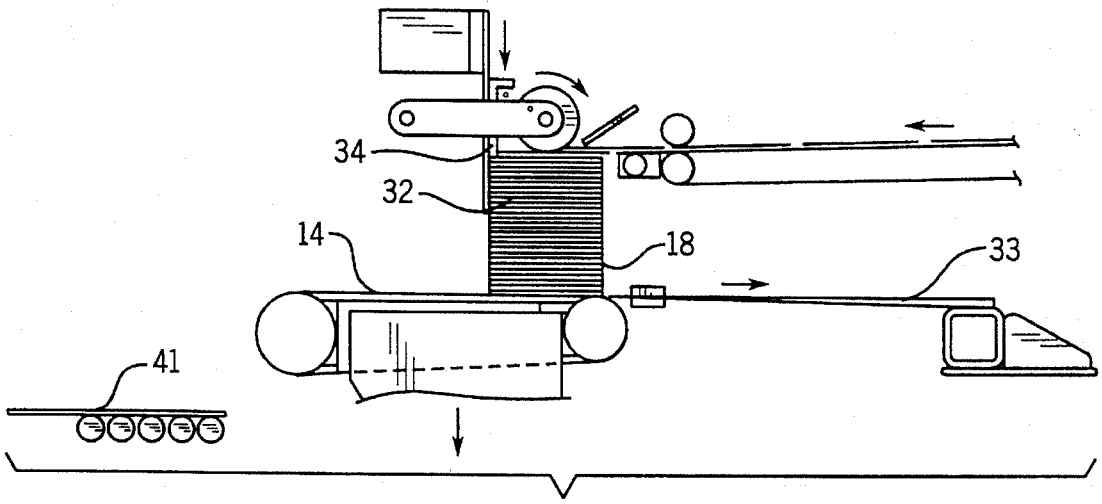

Also simultaneously with extension of the fork 33 and firing of the spanker 40, the rate of descent of the outfeed conveyor 14 and the lower stack portion 31 thereon is increased to a rate substantially greater than the rate of stack formation and descent of the supporting fork 33. Thus, as shown in FIG. 6, a gap is formed between the lower and upper stack portions 31 and 32 until the outfeed conveyor 14 reaches its lowermost position in horizontal alignment with a takeoff conveyor 41. At this point, the outfeed conveyor 14 is operated to transfer the stack portion 31 onto the takeoff conveyor 41 and out of the system, as shown in FIG. 7. The supporting fork 33 continues to drop with the stack at the stack formation rate. As soon as the lower stack portion 31 has cleared the outfeed conveyor 14, it is raised rapidly upward to a point closely spaced below the descending fork 33 and, after a short pause to permit the fork to reach the upper surface of the outfeed conveyor, the two descend together at the stack formation rate while the fork withdraws horizontally completely from beneath the stack 18 (see FIG. 10).

Figure 11:
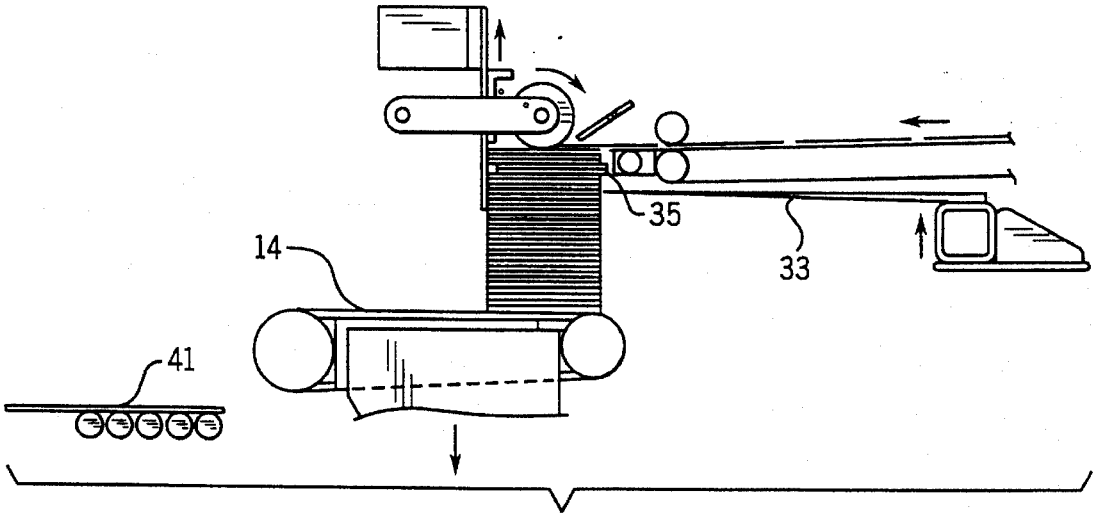
Figure 12:
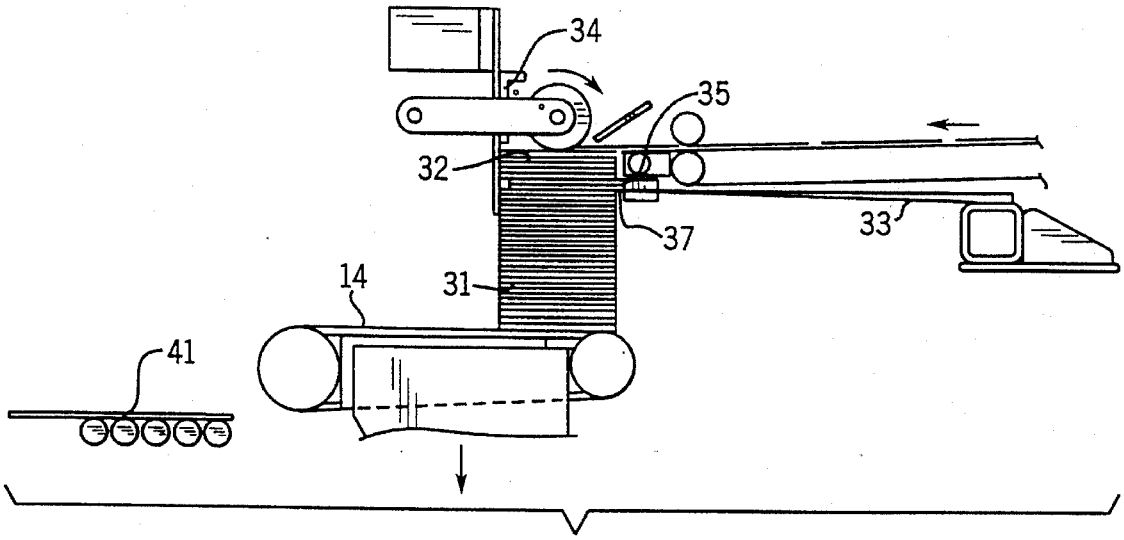
Figure 13:
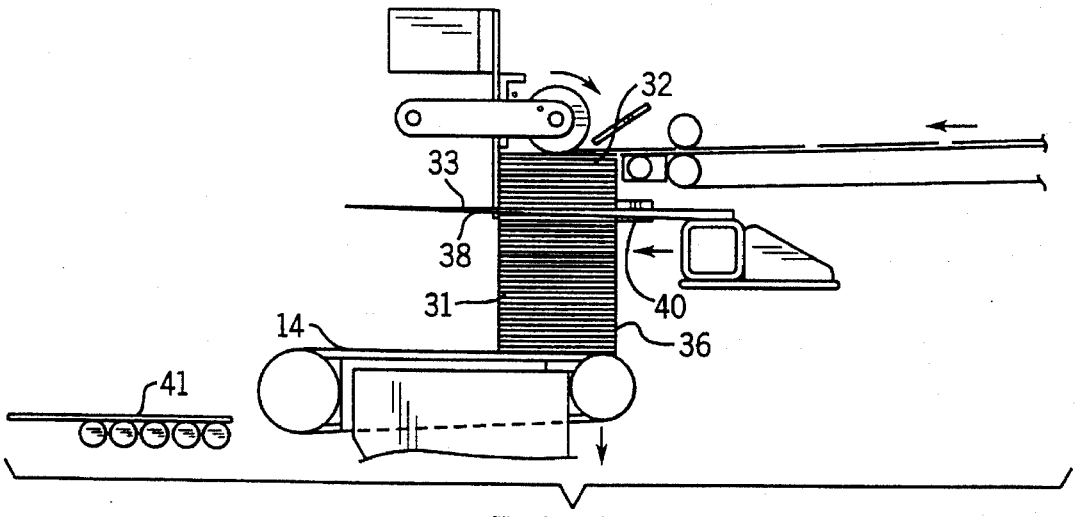

When the following stack portion 32 reaches the desired number of sheets, the false backstop 34 is again fired to move downwardly into its operative position. The fork 33 is raised rapidly upward to its ready position for engagement by the next stack offset 35, while the stack support surface on the outfeed conveyor 14 continues to drop at the stack formation rate, as may be seen in FIG. 11. In FIG. 12 (which is similar to FIG. 4), the false backstop has been retracted upwardly, the next upper stack portion 32 begins to form above the offset 35 which, in turn, drops at the bundle formation rate until it engages the ends 37 of the fork. This signals the repeat of the previously described cycle so that, in FIG. 13, as previously described with respect to FIG. 5, the fork again extends horizontally to separate and support the upper stack portion 32, the spanker 40 fires to realign the offset with the main upstream face 36 of the stack, and the forks simultaneously move downwardly at the stack formation rate. As shown and previously described with respect to FIG. 6, an immediate increase in the rate of descent of the outfeed conveyor 14 creates the gap between the stack portions 31 and 32 for discharge of the former, as previously described.

We claim:

1. A sheet stacking apparatus for serially forming and discharging vertical stacks of sheets comprising:

means for conveying a stream of the sheets at a first speed into a stacking station, including a vertically movable stack support surface;

a backstop forming a vertical rear wall of the stacking station;

shingling means in the stacking station for slowing the lead sheet in the stream to a second speed, for carrying the leading edge of the lead sheet into engagement with the backstop, and for causing the leading edge of a next following sheet to overlap the trailing edge of the lead sheet;

the shingling means including a backstop nip roll positioned above the stack support surface to define a nip spaced from the backstop by a distance approximately equal to the distance between the leading edge of the next following sheet and the backstop;

whereby the leading edge of the next following sheet is nipped simultaneously with engagement by the leading edge of the lead sheet with the backstop.

2. The apparatus as set forth in claim 1 including means for moving the stack support surface downwardly in response to stack formation.

3. The apparatus as set forth in claim 2 including means for moving the stack support surface downwardly at a rate equal to the rate of stack height formation.

4. The apparatus as set forth in claim 1 wherein said shingling means includes a vacuum shingler positioned between the sheet delivery means and the stack support surface.

5. The apparatus as set forth in claim 3 wherein the sheet conveying means comprises:

a belt conveyor having a downstream end positioned adjacent the vacuum shingler; and, an infeed nip roll positioned above the downstream end of the belt conveyor to form therewith an infeed control nip for the sheets.

6. The apparatus as set forth in claim 2 wherein said backstop nip roll comprises:

a pivotable support mounting the nip roll for pivotal movement about a horizontal axis to vary the vertical position of said nip roll; and, control means responsive to movement of the pivotal support for controlling the downward speed of said stack support surface.

7. The apparatus as set forth in claim 2 comprising:

a false backstop positioned to move vertically along the wall of the backstop between an inoperative upper position and an operative lower position in the path of sheets from the backstop nip to provide an upstream offset in the stack of sheets being formed, said offset defined by the trailing edges of a selected number of sheets;

a stack separating and supporting fork mounted below the sheet conveying means for horizontal supporting movement into said stack and vertical movement responsive to movement of the stack support surface; and, said supporting fork having free end portions positionable adjacent the upstream face of the stack to engage the upstream offset in response to vertical downward stack movement.

8. The apparatus as set forth in claim 7 including control means for varying the rate of movement of the stack support surface in response to horizontal movement of the supporting fork into the stack to provide separation of a lower stack portion on said stack support surface for discharge.

9. The apparatus as set forth in claim 8 wherein said stack support surface includes a discharge conveyor operative to provide horizontal discharge of said lower stack portion.

10. A method for forming individual stack portions of preselected numbers of sheets from a continuously forming vertical stack formed from a stream of sheets, the method comprising the steps of:

(1) conveying the sheets at a first speed into a stacking station including a vertical sheet engaging backstop;

(2) successively slowing the lead sheet in the stream entering the stacking station to a second speed prior to engaging the backstop;

(3) lowering the stack at a rate approximately equal to the rate of stack height formation;

(4) creating an upstream offset in the stack of sheets being formed, said offset defined by the trailing edges of a selected number of sheets;

(5) positioning the end of a stack separating device in the path of the offset to engage said offset during the preceding lowering step;

(6) moving the separating device horizontally into the stack under said offset to separate the stack into lower and upper stack portions; and, (7) discharging the lower stack portion from the path of stack formation.

11. The method as set forth in claim 10 wherein the step of slowing the lead sheet entering the stacking station comprises nipping the lead sheet between a nip roll and the next preceding sheet on the stack.

12. The method as set forth in claim 10 wherein the step of creating an offset comprises moving a false backstop into the path of said selected number of sheets entering the stacking station.

13. The method as set forth in claim 10 including the step of increasing the rate of lowering the lower stack portion in response to movement of the separating device into the stack.

14. A method for forming a continuous vertical stack of sheets from a stream of sheets, the method comprising the steps of:

(1) conveying the sheets at a first speed into a stacking station including a vertical sheet engaging backstop;

(2) successively slowing the lead sheet in the stream entering the stack station to a second speed prior to engaging the backstop by nipping the lead sheet between a nip roll and the next preceding sheet on the stack; and, (3) positioning the nip roll with respect to the backstop so the leading edge of the next following sheet reaches the nip roll when the leading edge of the lead sheet engages the backstop.

* * * * *